United States Patent [19]

Wiredal

[11] Patent Number: 4,545,443

[45] **Date of Patent: * Oct. 8, 1985**

[54] MEANS FOR DRILLING

[75] Inventor: Harry A. I. Wiredal, Sandviken, Sweden

[73] Assignee: Sandvik Aktiebolag, Sweden

[ * ] Notice: The portion of the term of this patent subsequent to Oct. 11, 2000 has been disclaimed.

[21] Appl. No.: 493,059

[22] Filed: Jun. 10, 1983

Related U.S. Application Data

[63] Continuation of Ser. No. 899,170, Apr. 24, 1978.

[30] Foreign Application Priority Data

Apr. 29, 1977 [SE] Sweden ..... 7704972

[51] Int. Cl.[4] ..... E21B 10/26; E21B 1/02

[52] U.S. Cl. ..... 175/258; 175/100; 175/171; 175/323

[58] Field of Search ..... 175/398, 171, 258, 324, 175/323, 395, 407, 408, 399, 92, 100, 101, 173

[56] References Cited

U.S. PATENT DOCUMENTS

| | | | |
|---|---|---|---|
| 2,250,671 | 7/1941 | Joy | 175/173 |
| 3,416,616 | 12/1968 | Ahlgren | 175/258 |
| 3,420,323 | 1/1969 | Owens | 175/323 |
| 3,682,260 | 8/1972 | Klemm | 175/92 |
| 3,848,683 | 11/1974 | Persson | 175/258 |
| 3,870,114 | 3/1975 | Pulk | 175/258 |
| 4,091,884 | 5/1978 | Thomas | 175/395 X |

FOREIGN PATENT DOCUMENTS

| | | | |
|---|---|---|---|
| 227369 | 10/1969 | Sweden | 175/171 |

*Primary Examiner*—James A. Leppink
*Assistant Examiner*—Hoang C. Dang
*Attorney, Agent, or Firm*—Pasquale A. Razzano

[57] ABSTRACT

Drilling means of the type having a pilot bit, a reamer and a guidemember mounted in the bottom end of the casing tube, and which transmits impacts to the casing. The guide member is snugly enclosed in the thickened mouth portion of the casing tube and has a plurality of channels which are segments of a spiral through which the drilling debris is discharged upwardly to the casing tube.

7 Claims, 4 Drawing Figures

MEANS FOR DRILLING

This is a continuation of application Ser. No. 899,170, filed Apr. 24, 1978.

The present invention relates to a means for drilling comprising a rotatable drilling tool adapted to drill a hole in advance of trailing casing tube means which are passed by rotatable drill rod means.

Drilling tools of the above character usually are provided in connection with a down-the-hole drilling machine, for instance where drilling a well, said drilling tool usually consisting of a centrally provided pilot bit and a rear eccentricaly provided reamer. The casing tube does not rotate, it follows the reamer by its own weight while the drill rod string rotates. Flushing medium is supplied to the tool through a central flushing bore provided through the casing and drill pipes.

For the discharge of drilling debris rearwardly, it has been proposed to maintain an annular slot of predetermined and substanially constant width between the mouth of said casing tube means and said drilling tool as described in U.S. Pat. No. 3,848,683. This arrangement enables sifting the flushing medium through said slot for preventing oversized drilling particles to be entrained into said slot and casing tube means. A disadvantage is that such arrangement does not permit sufficiently effective discharge of the drilling debris relative to the amount of flushing medium that can be supplied to the drilling tool, and adversely affects the drilling capacity.

According to the present invention, there is proposed a new drilling means of the type incorporating a rotatable drilling tool of the above character comprising a central drill bit and eccentrically disposed reamer. The reamer provides cutting edges in axial proximity rearwardly of the drill bit. The improvement comprises a cylindrical guide body disposed in coaxial relation to said bit and at the inside of said casing tube and of a diameter to provide sliding engagement with an interior cylindrical portion of said casing tube. The guide body has rearwardly extending slots on its peripheral surface for discharging drilling debris. Preferably, the slots are spiral. It has been found in practice that such a drilling means provides an important improvement in the capacity for removing drilling debris by flushing medium rearwardly through the casing tube. The drilling means of the present invention with the guide body in sliding engagement with the interior of said casing tube also provides improved guiding performance, a simplification of the previously related construction.

The invention will now be described in more detail with reference to the accompanying drawings in which one embodiment of the invention is illustrated by way of example, in which FIG. 1 is a side elevation, partially in section, of a prior art drillng means for earth drilling;

Figure 1:
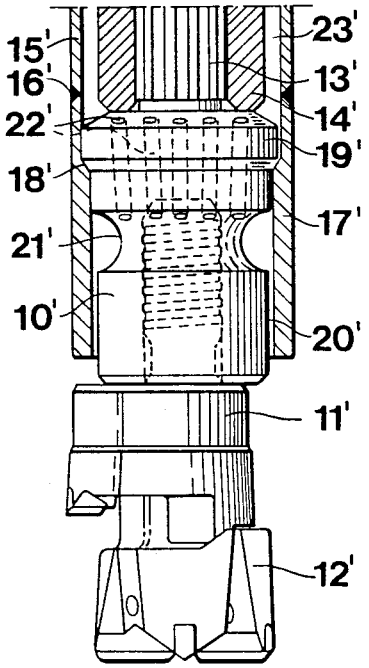
Fig.1 PRIOR ART

In the drawings, FIG. 1 shows an eccentric drill tool intended for a down-the-hole drill application, having a cylindrical guide member 10', an eccentric reamer 11' and a central pilot bit 12'. The upper portion of the shaft of the guide member is a splined shank 13', and it is rotatably connected to the lower end portion of a drill pipe 14' and thence to a drilling machine (not shown).

Guide member 10' is located in a casing tube 15', the lower end of which is welded at 16' to a thickened mouth portion 17'. An internal upward annular driving shoulder 18' mates with the shoulder of a flange 19' on guide member 10' so that the impacts of the drill can be transmitted to the casing tube means 15'. The lower portion of guide member 10' has a reduced diameter so as to provide a peripheral annular slot 20' between the guide member mouth portion 17'. Flushing medium and drilling debris is passed through slot 20' into an annular groove 21' in the guide member and then through a plurality of substantially axial bores 22' into an annular space 23' in the casing for elevation and removal by continued flushing. A disadvantage here is that removal of drilling debris rearwardly is of too limited capacity in comparision with those amounts of flushing medium that can be delivered to the drilling tool. Especially when drilling in mixtures of earth and mud, it has been found that said axial bores 22' often become silted-up, thus resulting in restricting the removal of debris.

Figure 2:
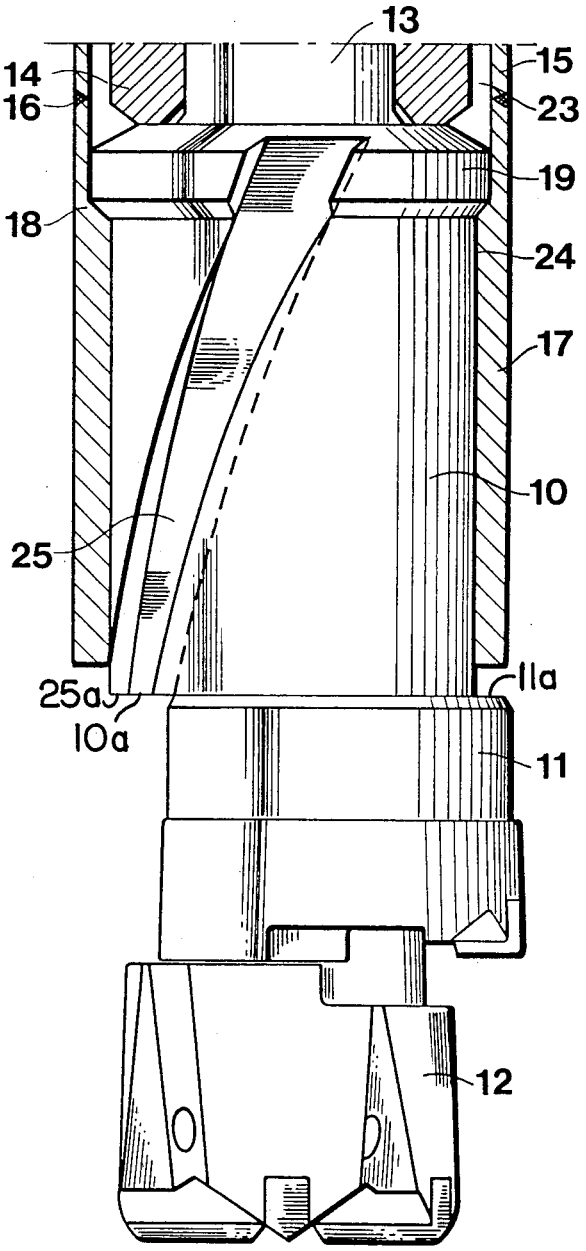
FIG. 2 is a view similar to FIG. 1 but showing a drilling means according to the present invention.
Figure 3:
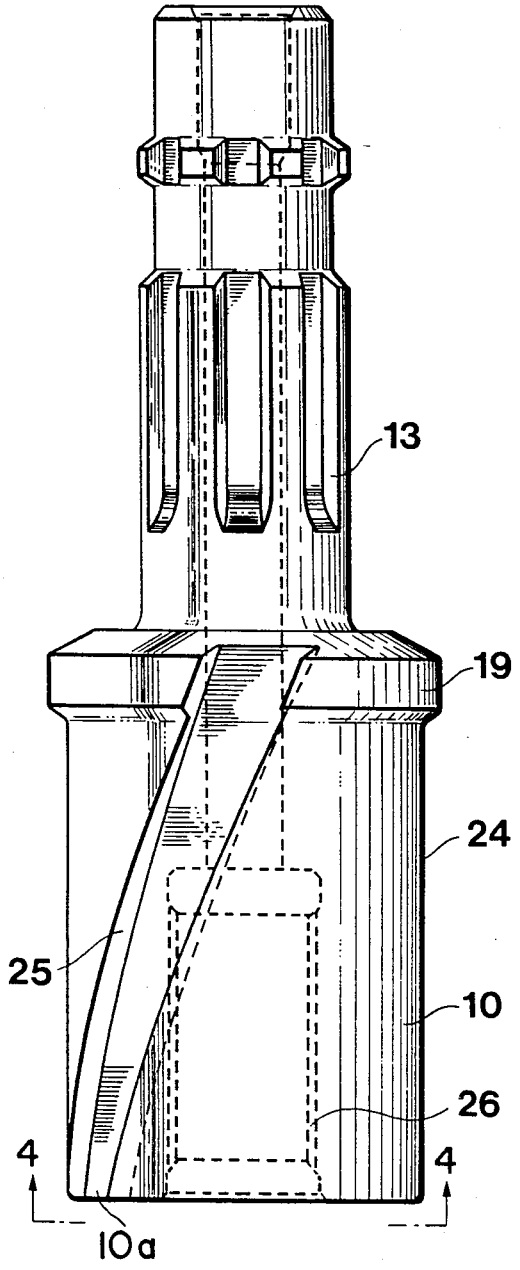
FIG. 3 is a side elevation of the guide member of the drilling means of FIG. 2; and, FIG. 4 is an end view on the line 4—4 in FIG. 3.
Figure 4:
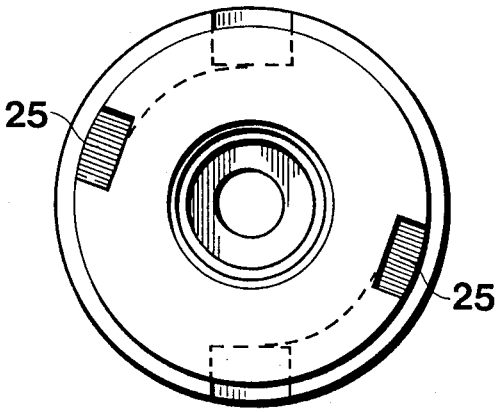

With the illustrative embodiment of the invention of FIGS. 2, 3 and 4, corresponding parts of the structure have been given the same reference numerals as in FIG. 1 except that the prime markings are omitted. The drilling means of the invention includes a cylindrical guide member 10, a reamer 11 having eccentric cutting edge means and a centrally provided pilot bit 12. As shown in FIG. 2, reamer 11 is mounted between member 10 and bit 12 with its rear end **11*a* engaged with the face 10*a* of body 10. The reamer is mounted on an intermediate portion of the rearwardly extending and exteriorly threaded shaft (not shown) of the pilot bit, and guide member 10 is disposed on the rear end of said shaft in coaxial relation with the pilot bit. The guide member also has a rearwardly extending shaft portion 13 (FIG. 3) that is splined so as to be rotatable by drill pipe 14. The diameter of the main or forward portion 24 of guide member 10 is such as to provide a sliding engagement with the interior cylindrical portion of thickened mouth portion 17 of casing tube 15. Mouth portion 17 is welded to the casing tube at 16. A shoulder 18 is provided interiorly of mouth portion 17 for cooperation with a flange 19 on guide member 10 for transmitting impacts to casing tube 15**.

The forward or main portion 24 of guide member 10 has the same diameter as the interior diameter of mouth portion 17 so that there is a sliding engagement therebetween. For the removal of drilling debris rearwardly, four recesses 25 are provided in the cylindrical surface of said main portion 24 of the guide member. Recesses 25 should preferably be spiral, as illustrated. This gives the advantage that very small particles will not tend to wedge and become entrained between main portion 24 and mouth portion 17. They will, instead, be brought rearwardly through spiral recesses 25 during rotation of the drilling tool. These recesses should extend axially along main portion 24 of guide member 10 from an open end **25*a* in the front face 10*a* of member 10 through flange 19. Further, said recesses are evenly distributed around the circumference of guide member 10, illustratively, two pairs, each diametrically opposed, as shown in FIG. 4. This gives the advantage of eliminating problems with the location of the entrance of the exterior thread of the shaft of the bit 12 relative to the location of said recesses when installing said threaded bit shaft into its threaded bore 26 in guide member 10**.

Recesses 25 should suitably be U-shaped in cross-section with straight side walls and of uniform depth, and the width should exceed the radial depth thereof. Provision of externally provided recesses on the cylindrical surface of the guide member, as alternative to the prior art solution disclosed in FIG. 1, has been shown to give clear improvements in the drilling capacity under vaious conditions.

The references herein to "rearward" and "forward" mean away and toward the drill bit, respectively, in the sense that the drill bit is moving forward to produce the hole and the debris is being removed rearwardly.

In accordance with the present invention, the drill bit is guided accurately and the debris is removed efficiently. The spiral configuration of recesses 25 combine with the rotation of the drill to tend to lift the debris so as to improve the flow rearwardly past the main portion 24.

It should be understood that this embodiment of the invention is only illustrative of the invention and that various modifications thereof may be made within the scope of the claims following hereinafter.

What is claimed is:

1. Means for drilling of the type comprising a rotatable drilling tool adapted to drill a hole in advance of a trailing casing tube means which are moved by rotatable drill rod means, said casing tube means having a forward mouth portion with a cylindrical interior surface, said drill rod means and said casing tube means having an annular space therebetween, said drilling tool comprising a central bit, an eccentrically disposed reamer cutting edge means in axial proximity rearwardly of said bit and a cylindrical guide body in coaxial relation to said bit, the forward portion of said guide body having such a diameter as to provide sliding engagement with the interior cylindrical surface of said mouth portion of said casing tube means, said guide body having at least one rearwardly-extending recess in the cylindrical surface of its forward portion for the discharge of drilling debris rearwardly to said annular space provided between said rotatable drill rod means and said casing tube means, said recess being U-shaped in cross-section and the width of said recess exceeding the radial depth thereof, said drilling tool and said guide body being connected to a rotatable drill tube associated with a down-the-hole drilling machine and said casing tube having at its lower end a thickened mouth portion providing an upward annular driving shoulder for cooperation with a flange on said guide body for transmitting impacts to said casing tube, said at least one rearwardly extending recess extending along said forward portion of said guide body and also passing axially through said flange on said guide member.

2. In a drilling machine of the type having a rotatable drilling tool for drilling a hole in advance of a trailing casing tube which has a cylindrical inner surface and a rotatable drill rod assembly attached to said drilling tool, wherein said drilling tool includes a central pilot bit and an eccentric cutting bit, and wherein said casing tube has a cylindrical mouth portion upon its forward end which is of reduced diameter and forms an annular driving shoulder adjacent said inner surface of said casing tube, and wherein said drilling tool has a cylindrical body with a portion which is snugly received in said mouth portion and a flange portion which is adjacent and in trailing relationship thereto and is snugly received in the casing tube, said body thereby providing a forward driving relationship between said flange portion and said mouth portion, and said body holding said drilling tool in axial alignment with said casing tube by the sliding relationship between the cylindrical inner surfaces of said casing tube and said mouth portion and the mating surface portions of said body, said body having at least one groove which extends axially thereof and provides a passageway for the discharge of drilling debris rearwardly from the leading portion of said drilling tool to the annular space between said drill rod means and said casing tube.

3. Means for drilling of the type comprising a rotatable drilling tool adapted to drill a hole in advance of a trailing casing tube means which are moved by rotatable drill rod means, said casing tube means having a forward mouth portion with a cylindrical interior surface, said drill rod means and said casing tube means having an annular space therebetween, said drilling tool comprising a central bit, an eccentrically disposed reamer cutting edge means is axial proximity rearwardly of said bit and a cylindrical guide body in coaxial relation to said bit rearwardly of said reamer and in engagement therewith, the forward portion of said guide body having a generally cylindrical outer surface having a diameter substantially equal to the internal diameter of the cylindrical interior surface of said mouth portion thereby to provide sliding engagement with the interior cylindrical surface of said mouth portion of said casing tube means, said guide body having at least one rearwardly-extending slot formed in the cylindrical surface of its forward portion for the discharge of drilling debris rearwardly to said annular space provided between said rotatable drill rod means and said casing tube means; said rearwardly extending slot on said guide body being a low pitched spiral.

4. Means for drilling of the type comprising a rotatable drilling tool adapted to drill a hole in advance of a trailing casing tube means which are moved by rotatable drill rod means, said casing tube means having a forward mouth portion with a cylindrical interior surface and a free end, said drill rod means and said casing tube means having an annular space therebetween, said drilling tool comprising a central bit, an eccentrically disposed reamer cutting edge means in axial proximity rearwardly of said bit and a generally cylindrical guide body in coaxial relation to and fixed to said bit, the forward portion of said guide body having a generally cylindrical outer surface extending beyond the free end of said mouth portion and having such a diameter as to provide sliding engagement with the interior cylindrical surface of said mouth portion of said casing tube means, said guide body having a front face adjacent said reamer and at least one rearwardly-extending slot formed in the cylindrical surface of its forward portion, said slot extending rearwardly from an open end at said front face of the guide body and communicating directly with said annular space to provide for the direct discharge of drilling debris from below said guide body rearwardly to said annular space provided between said rotatable drill rod means and said casing tube means; said reamer cutting edge means having a top surface engaging the front face of said guide body but exposing the open end of the slot whereby forces applied to the reamer are transmitted through said top surface to said guide body and thence to said cylindrical interior surface of said forward mouth portion while said slot remains open for discharge of drilling debris.

5. Means for drilling of the type comprising a rotatable drilling tool adapted to drill a hole in advance of a trailing casing tube means which are moved by rotatable drill rod means, said casing tube means having a forward mouth portion with a cylindrical interior surface, said drill rod means and said casing tube means having an annular space therebetween, said drilling tool comprising a central bit, an eccentrically disposed reamer cutting edge means in axial proximity rearwardly of said bit and a generally cylindrical guide body in coaxial relation to said bit, the forward portion of said guide body having a maximum diameter as to provide sliding engagement with the interior cylindrical surface of said mouth portion of said casing tube means, said guide body having a front face adjacent said reamer and at least one rearwardly-extending recess in the cylindrical surface opening at one end in said front face and at an opposite end to said annular space to provide communication between for the direct discharge of drilling debris rearwardly to said annular space provided between said rotatable drill rod means and said casing tube means, said recesses being U-shaped in cross-section and the width of each said recess exceeding the radial depth thereof, said reamer cutting edge means having a top surface engaging the front face of said guide body whereby forces applied to the reamer are transmitted through said top surface to said guide body and thence to said cylindrical interior surface of said forward mouth portion.

6. Means for drilling of the type comprising a rotatable drilling tool adapted to drill a hole in advance of a trailing casing tube means which are moved by rotatable drill rod means, said casing tube means having a forward mouth portion with a cylindrical interior surface and a free end, said drill rod means and said casing tube means having an annular space therebetween, said drilling tool comprising a bit assembly which is centrally positioned with respect to the axis of said casing tube means, a reamer cutter presenting cutting edge means in axial proximity and rearwardly with respect to said bit assembly, a guide body attached to and supporting said bit assembly and slidably positioned in said forward mouth portion and the adjacent portion of said casing tube means and presenting a plurality of guide surfaces mating with said interior surface of said forward mouth portion whereby said drilling tool is guided and maintaind in precise axial alignment during its movement with respect to said forward mouth portion, said guide body having a forward end located beyond the free end of said mouth portion in engagement with said reamer and at least one slot means extending axailly along the surface of said guide body from said forward end of the guide body adjacent the reamer cutter to said annular space to thereby provide for the direct discharge of drilling debris rearwardly from the forward end of said forward mouth portion to said annular space, whereby said guide body holds said bit assembly in precise alignment during successsive axial drilling strokes of said bit assembly and drilling debris materials are forced rearwardly from said bit assembly into said annular space, said cutter reamer having a top surface which resets against the bottom surface of said guide body whereby eccentric forces are transmitted through said top surface to said guide body and thence to said cylindrical interior surface of said forward mouth portion; said reamer cutting edge means having a top surface engaging the front face of said guide body but exposing the open end of the slot whereby forces applied to the reamer are transmitted through said top surface to said guide body and thence to said cylindrical interior surface of said forward mouth portion while said slot remains open for discharge of drilling debris.

7. Means for drilling of the type comprising a rotatable drilling tool adapted to drill a hole in advance of a trailing casing tube means which are moved by rotatable drill rod means, said casing tube means having a forward mouth portion with a cylindrical interior surface of reduced diameter and forms a driving shoulder adjacent the inner surface of the casing tube means, said drill rod means and said casing tube means having an annular space therebetween, said drilling tool comprising a central bit and an eccentrically disposed reamer cutting edge means in axial proximity rearwardly of said bit and a cylindrical guide body in coaxial relation to said bit, the forward portion of said guide body having a forward portion of such a diameter as to provide sliding engagement with the interior cylindrical surface of said mouth portion of said casing tube means, said guide body having a portion of enlarged diameter extending rearwardly from said forward portion which is of substantially the diameter of the adjacent portion of said casing tube means to define a flange for engaging said shoulder to provide a forward driving relationship between said body and said mouth portion, said guide body having at least one recess which extends the axial length thereof to provide for the passage of drilling debris rearwardly from below said guide body to said annular space between said drill rod and said casing tube means, whereby said guide body provides the function of holding said bit assembly in precise alignment during successive axial drilling strokes of said bit assembly and provides for drilling debris materials to be forced rearwardly from said bit assembly into said annular space.

* * * * *